US007497367B2

(12) United States Patent
Miranda

(10) Patent No.: US 7,497,367 B2
(45) Date of Patent: Mar. 3, 2009

(54) TWO-WAY WINDOW ENVELOPE

(76) Inventor: Darrell Roberto Miranda, 5064 SW. 161 Ave., Miramar, FL (US) 33027

( * ) Notice: Subject to any disclaimer, the term of this patent is extended or adjusted under 35 U.S.C. 154(b) by 630 days.

(21) Appl. No.: 11/175,588

(22) Filed: Jul. 6, 2005

(65) Prior Publication Data

US 2007/0007326 A1 Jan. 11, 2007

(51) Int. Cl.
*B65D 27/06* (2006.01)

(52) U.S. Cl. ..... 229/302; 229/303; 229/306

(58) Field of Classification Search ..... 229/302–306
See application file for complete search history.

(56) References Cited

U.S. PATENT DOCUMENTS 1,575,769 A * 3/1926 Kaye ..... 229/303
5,224,647 A * 7/1993 Yanow ..... 229/302
5,400,957 A * 3/1995 Stude ..... 229/303
5,738,274 A * 4/1998 Stude ..... 229/301

* cited by examiner

*Primary Examiner*—Jes F Pascua

(57) ABSTRACT

The subject invention, like prior two-way envelopes, relates to a remailable envelope formed from a blank which is symmetrical about its center line. The blank consists of three panels that are connected along fold lines: the front panel of the envelope, the back panel of the envelope and a third panel which is the resealing return flap. The front panel has a top flap and a pair of opposed side flaps that are used to construct the envelope. In addition, the front panel contains a viewing window for the original addressee and a return window for the return addressee. The resealing return flap is connected to the back panel by a fold line extending along the top edges of the back panel and resealing return flap and, for the initial mailing, is also attached to the back panel with weak adhesive spots that permit easy detachment for the return mailing. The resealing return flap contains a strategically placed window that is covered by the top sealing flap of the envelope during the initial mailing. For the return mailing the resealing return flap will cover the entire front panel, with the resealing return flap window overlaying the original return address window which permits viewing of the address for the return recipient that is printed on an enclosure in the envelope.

9 Claims, 1 Drawing Sheet

Illustrations
*Miranda*
*Two Way Window Envelope*
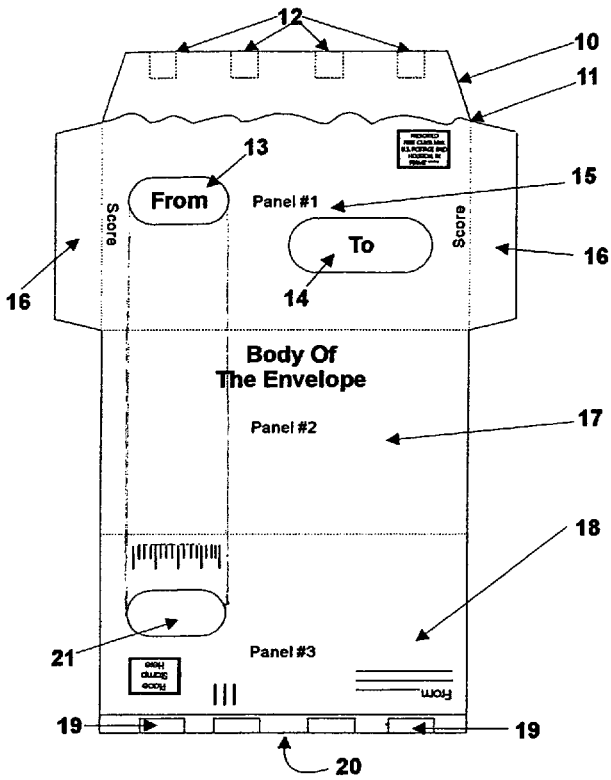
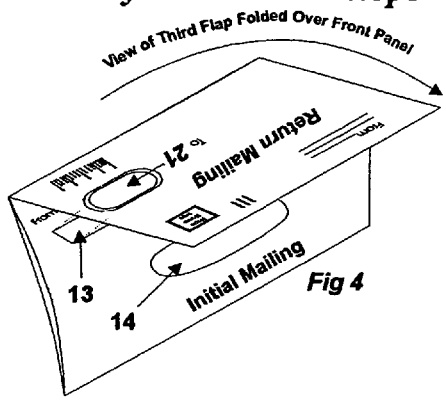
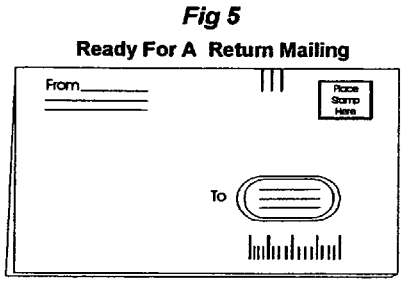
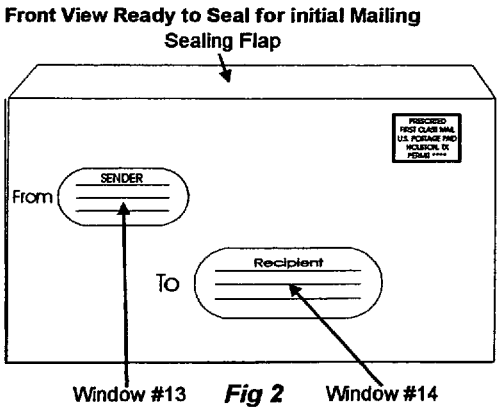
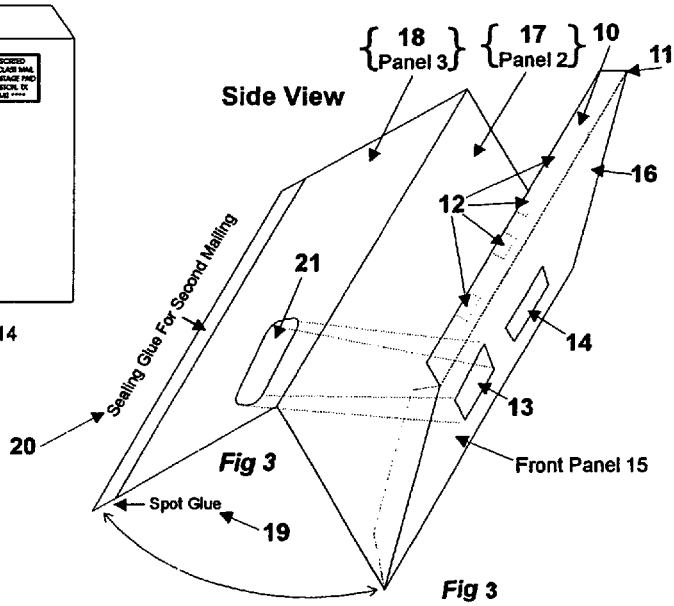
INVENTOR
DARRELL MIRANDA

TWO-WAY WINDOW ENVELOPE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

The principal object of the invention is to provide a two-way window envelope which may be used by mailers having multiple return addresses without the necessity of printing return envelopes for each different return address. This will allow bulk purchases of one type of envelope which can be distributed to the various original senders in accordance with the logistical requirements of the parent company.

Two-way envelopes have been produced in different ways, but are typically not produced in one single blank as a two-way window envelope which can be used for return to different original mailers without having to print envelopes for each return address. The subject invention accomplishes this through the strategic placement of three revealing windows as described below. Two-way envelopes described in prior art do not carry a window for the return address of the original mailer thereby requiring the printing of different addresses for different original mailers. This eliminates some of the savings from bulk purchasing of envelopes by the parent company for distribution to subsidiaries with different return addresses. Other types of two-way envelopes have the resealing return flap folded into the pocket of the envelope for the initial mailing. This feature can interfere with stuffing of the envelope and the return flap is subject to damage when it is removed from the envelope for remailing by the initial recipient. Examples of these types of envelopes are described in U.S. Pat. Nos. 1,575,769, Kaye, 1926; 3,558,040, Krueger, 1971; 5,224,647, Yanow, 1993; and 5,738,274, Stude, 1998. The subject invention addresses these issues.

BRIEF SUMMARY OF THE INVENTION

The subject invention, like prior two-way envelopes, relates to a remailable envelope formed from a blank which is symmetrical about its center line. The blank consists of three panels that are connected along fold lines: the front panel of the envelope, the back panel of the envelope and a third panel which is the resealing return flap. The front panel has a top flap and a pair of opposed side flaps that are used to construct the envelope. In addition, the front panel contains a viewing window for the original addressee and a return window for the return addressee. The resealing return flap is connected to the back panel by a fold line extending along the top edges of the back panel and resealing return flap and, for the initial mailing, is also attached to the back panel with weak adhesive spots that permit easy detachment for the return mailing. The resealing return flap contains a strategically placed window that is covered by the top sealing flap of the envelope during the initial mailing. For the return mailing the resealing return flap will cover the entire front panel, with the resealing return flap window overlaying the original return address window which reveals the address for the return recipient on the contents of the envelope.

BRIEF DESCRIPTION OF THE SEVERAL VIEWS OF THE DRAWINGS

FIG. 1 is a plan view of the two-way window envelope in its unfolded form showing the front panel, back panel, sealing flaps, resealing return flap and three windows in accordance with one embodiment of the invention.

FIG. 2 is a front view of the envelope with a window for the original sender in the upper left corner and a window for the original recipient in the center of the envelope in accordance with one embodiment of the invention.

FIG. 3 is a side view showing the folding of the one-piece blank to form the two-way window envelope in accordance with one embodiment of the invention.

FIG. 4 is a view of the final step in the return mailing with the original return address window of the front panel in alignment with the resealing return flap window, thus revealing the name and address of the original sender for the first mailing which has become the name and address of the recipient for the return mailing in accordance with one embodiment of the invention.

FIG. 5 is a front view of the two-way envelope ready for mailing with the resealing return flap now shown as the front panel and the original sender now shown as the new recipient in accordance with one embodiment of the invention.

DETAILED DESCRIPTION OF THE INVENTION

The subject invention, a two-way window envelope is comprised of three (3) rectangular panels of the same dimensions: front panel 15, back panel 17 and resealing return flap 18, one top sealing flap 10 attached to the front panel 15 through a perforated line, and two side flaps, all as shown in FIG. 1, and made from a single blank die-cut and ready for assembly as follows. The front panel 15 and back panel 17 have the same rectangular dimensions and share the bottom edge of the envelope. Side flaps 16 on the front panel 15 attach to the back panel 17 to form the pocket of the envelope that may be filled manually or handled on automatic inserting equipment for sending out large mailings for which a return is desired.

The resealing return flap 18 hinges from the top of the back panel 17 and is attached to the bottom of that panel with adhesive spots 19. Since the adhesive spots do not adhere strongly to the mating surface, this facilitates disconnecting the resealing return flap 18 from the outer surface of the back panel 17 when the original recipient is ready to send the envelope back.

Correspondence is inserted into the pocket for the initial mailing so that the name and address of the sender are showing through window 13 and the name and address of the recipient are showing through window 14. The envelope is then closed with the top sealing flap 10 which is provided with 3 or 4 weak adhesive spots for easy opening. The initial recipient opens the envelope by sliding a finger or letter opener under the top sealing flap 10 and then removing that flap by tearing at the perforations 11.

The envelope is prepared for return mailing by inserting the return material with the address of the original sender showing upside down through the top window 13 of the front panel 15.

The resealing return flap 18 is detached from the outer surface of the back panel 17 by releasing the weak adhesive spots 19 at the bottom of the panel. As shown in FIG. 4 the resealing return flap is then folded over in a 360-degree motion to cover the front panel 15 and sealed at the bottom by the adhesive strip 20. This brings window 21 into perfect register with window 13 and covers the balance of the front panel 15. The original mailer's name and address are thus revealed through windows 13 and 21 and they are now the name and address of the return consignee. Covering the front panel with the resealing return flap has the effect of inverting the front panel. The original recipient, this time as sender, enters his/her return address in the space provided above and to the left of the window. The resealing return flap 18 is preprinted with numbers, bar codes, permits and other requested or required information. The envelope is thus ready for return mailing.

The two-way reusable function of the envelope depends on the location of three windows. As shown in FIG. 2, the first window 13, located in the upper left corner of the front panel is, reveals the name and address of the original mailer. The position of this window is critical because it becomes the window that reveals the addressee of the return mailing. The second window 14, also shown in FIG. 2, is located in the center of the front panel 15 reveals the name and address of the original recipient. The location of the window can vary depending on the position of the recipient's name that is printed on the contents of the envelope. This window will be covered by the resealing return flap 18 when it is folded over the front panel, revealing only the name and address of the return recipient through the third window 21, perfectly aligned over the first window 13. The third window 21 is located on the upper left corner of the resealing return flap 18. As shown in FIG. 1 it is positioned to be aligned with window 13 which it will overlay for remailing. In the first mailing this window is covered by the top sealing flap 10 of the envelope. Once this flap is separated along the perforated line 11 and discarded when the recipient opens the envelope, window 21 will be exposed for the return mailing. The return mailing material is inserted into the envelope with the returning name and address positioned upside down to face window 13. As described above, the resealing return flap 18 is then folded over the front panel 15, placing window 21 in perfect alignment with window 13, revealing this time the name and address of the original mailer, now becoming the addressee of the return mailing.

The advantage of using the original return address window 13 of the front panel 15 for remailing should be noted. As can be seen in FIG. 3 and FIG. 4, it allows window 21 to be positioned high on the resealing flap 18 where it can be covered by a short top sealing flap 10 for the original mailing. If the original recipient address window 14 were used for remailing it would require a much lower position for window 21 on the resealing return flap 18 to obtain the proper overlay of window 14 for the return mailing. This in turn would require a longer, less convenient and more expensive top sealing flap 10.

FIG. 5 is a front view of the two-way envelope ready for return mailing.

The two windows carried by the front panel may be covered with a patch of transparent material which facilitates insertion of contents when using an automatic insertion machine. The alternative embodiment of this transparent patch adds an extra advantage to the two-way window envelope since this same patch that is used for the first mailing will remain intact for the second mailing, giving the customer a protective transparent patch coming and going.

What I claim:

1. A two-way envelope formed from an envelope blank, wherein said two-way envelope is symmetrical about its center line, and said two-way envelope comprises:

a. a front panel comprising a window for the original recipient address and a window for the original return address, wherein said front panel is rectangular in shape and comprises inner and outer surfaces;

b. a back panel, comprising inner and outer surfaces, wherein said back panel is of the same dimensions as the front panel;

c. said back panel connected to said front panel by a fold line extending along the bottom edges of the front and back panels;

d. a resealing return flap, comprising inner and outer surfaces, wherein the resealing return flap has the same dimensions as the front panel; wherein said resealing return flap is connected to the back panel by a fold line extending along the top edge of the back panel and the top edge of the resealing return flap, wherein the resealing return flap is connected to the top of the back panel through the fold line connecting the resealing return flap to the back panel, for an initial mailing, the resealing return flap is attached to the bottom of the back panel using weak adhesive spots permitting easy detachment for a return mailing, and wherein the resealing return flap comprises a resealing return flap window located to overlay the window for the original return address when the two-way envelope is prepared for the return mailing;

f. a top sealing flap, wherein the top sealing flap is connected to the top edge of the front panel by a perforated tear line, wherein the perforated tear line extends along the top edge of the front panel, and wherein said top sealing flap covers said resealing return flap window in said initial mailing;

g. a first opposed side sealing flap, wherein the first opposed side sealing flap is connected to the front panel by a fold line extending along one of the two sides of the front panel; and h. a second opposed side sealing flap, wherein the second opposed side sealing flap is connected to the front panel by a fold line extending along the remaining one of the two sides of the front panel.

2. The two-way envelope of claim 1 wherein the window for the original recipient address and the window for the original return address are carried on the front panel, and the resealing return flap carries an overlay window, wherein the overlay window overlays the window for the original return address when the two-way envelope is prepared for the return mailing.

3. The two-way envelope of claim 1 wherein the top sealing flap extends over the window of the resealing return flap when the envelope is sealed, thereby hiding this window during the first mailing.

4. The two-way envelope in claim 1, wherein the resealing return flap is connected to the top edge of the back panel through a fold line, and wherein the resealing return flap for is attached to the bottom of the back panel with weak adhesive spots that permit easy detachment for the return mailing.

5. The two-way envelope in claim 1, wherein the top sealing flap is connected to the front panel by a perforated line, and wherein the top sealing flap is attached to the resealing return flap using weak adhesive spots, wherein the weak adhesive spots make the initial seal flap easily separable from the two-way envelope for the return mailing.

6. The two-way envelope in claim 1, wherein the resealing return flap folds over the front panel of the two-way envelope, placing the window of the resealing return flap in alignment with the window for the original return address, thereby revealing a return addressee printed on a communication sent back to an original sender using the return mailing.

7. The two-way envelope in claim 1, wherein the two-way envelope further comprises a set of bar codes and a set of other mailing information, wherein the set of bar codes and the set of other mailing information are located on the front of the front panel of the two-way envelope, and wherein the set of bar codes and the set of other mailing information are hidden by the resealing return flap when the resealing return flap is folded over the front panel for the return mailing.

8. The two-way envelope in claim 7, wherein the set of bar codes and the set of other mailing information located on the front of the front panel of the two-way envelope are pre-printed on the inner surface of the resealing return flap, and wherein the set of bar codes and the set of other mailing information is revealed on the front of the front panel of the two-way envelope when said resealing return flap is folded over the front panel for the return mailing.

9. The two-way envelope in claim 1, wherein the resealing return flap comprises an adhesive strip, wherein the adhesive strip is attached over the front panel of the two-way envelope for the return mailing.

* * * * *